US006877197B1

(12) United States Patent
Van Trump et al.

(10) Patent No.: US 6,877,197 B1
(45) Date of Patent: Apr. 12, 2005

(54) PROCESS FOR TREATING A POLYESTER BICOMPONENT FIBER

(75) Inventors: James E. Van Trump, Wilmington, DE (US); Carmen A. Covelli, Chadds Ford, PA (US); Jamie Lee Gossler, Wilmington, DE (US); Clive Mapp, Gloucester (GB); David J. Marfell, Moreton-in-Marsh (GB)

(73) Assignee: Invista North America S.A.R.L., Wilmington, DE (US)

( * ) Notice: Subject to any disclaimer, the term of this patent is extended or adjusted under 35 U.S.C. 154(b) by 0 days.

(21) Appl. No.: 10/730,372

(22) Filed: Dec. 8, 2003

(51) Int. Cl.[7] ..... D02G 1/00; D01D 5/22

(52) U.S. Cl. ..... 28/247; 28/220; 28/28; 28/281; 264/168

(58) Field of Search ..... 28/220, 240, 247, 28/248, 249, 252, 258, 281, 271, 244–246; 264/168, 172.11, 177.13, 210.5, 210.8, 211.14, 211.2, 211.18; 428/362, 369, 370

(56) References Cited

U.S. PATENT DOCUMENTS 3,671,379 A * 6/1972 Evans et al. ..... 264/172.12
3,719,976 A * 3/1973 Izawa et al. ..... 28/265
6,284,370 B1 * 9/2001 Fujimoto et al. ..... 428/364
6,333,106 B2 * 12/2001 Howell et al. ..... 428/364
6,335,093 B1 * 1/2002 Mori et al. ..... 57/238
6,641,916 B1 * 11/2003 Chang et al. ..... 428/373
6,740,270 B2 * 5/2004 Hwo et al. ..... 264/103
2002/0071951 A1 * 6/2002 Hernandez et al. ..... 264/168
2002/0116802 A1 * 8/2002 Moerman et al. ..... 28/258
2003/0111171 A1 * 6/2003 Casey et al. ..... 156/296

* cited by examiner

*Primary Examiner*—A. Vanatta
(74) *Attorney, Agent, or Firm*—Robert B. Furr, Jr.

(57) ABSTRACT

The invention provides a process for treating a polyester fiber comprising the steps of providing a bicomponent fiber comprising poly(ethylene terephthalate) and poly (trimethylene terephthalate) which has been heat-treated at a first temperature and cooled to lower than about 70° C. and has an initial crimp contraction value and a developed crimp contraction value, applying tension to the fiber of about 0.001 to 0.088 dN/tex, heat-treating the fiber at a second heat-treating temperature no lower than about 75° C. and no higher than the first heat-treating temperature, cooling the fiber to lower than the second heat-treating temperature, and releasing the tension from the fiber to give a fiber having a reduced crimp contraction value. The invention also provides a bicomponent fiber comprising poly(ethylene terephthalate) and poly(trimethylene terephthalate) having a reduced crimp contraction value of about 6% to 15%.

7 Claims, 1 Drawing Sheet

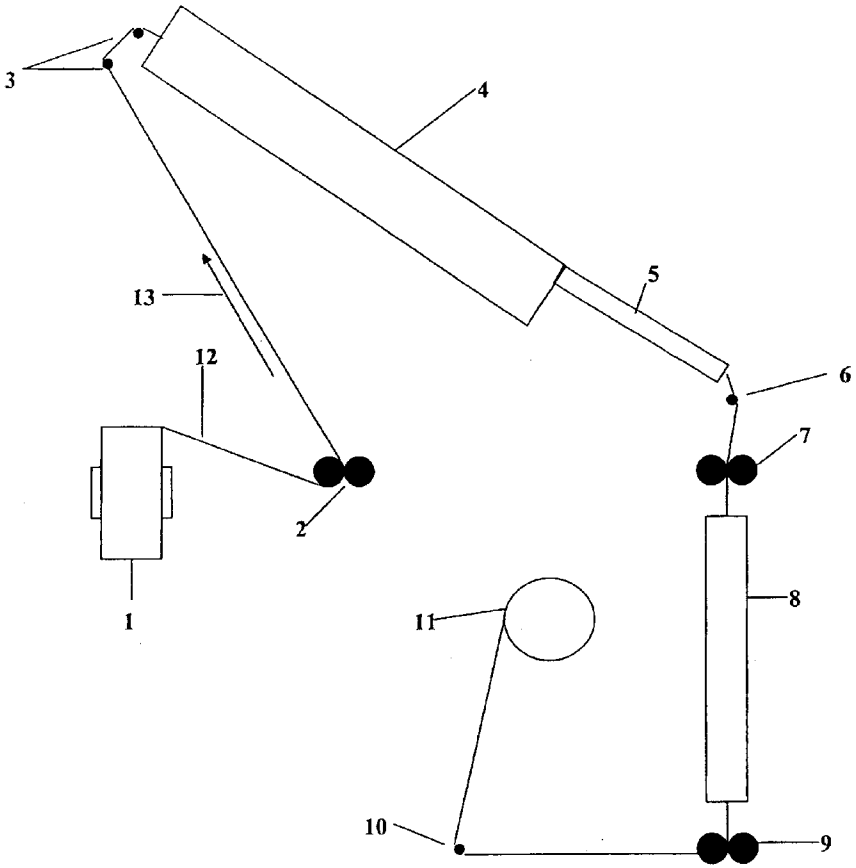
1
2
3
4
5
6
7
8
9
10
11
12
13

PROCESS FOR TREATING A POLYESTER BICOMPONENT FIBER

FIELD OF THE INVENTION

This invention relates to a bicomponent polyester fiber comprising poly(ethylene terephthalate) and poly (trimethylene terephthalate) having certain crimp properties and to a process for adjusting the crimp of such a fiber, and more particularly to a process for reducing and then restoring the crimp of such a fiber.

BACKGROUND OF THE INVENTION

Synthetic bicomponent fibers comprising poly(ethylene terephthalate) and poly(trimethylene terephthalate) are known. Such fibers are disclosed, for example, in U.S. Pat. No. 3,671,379, International Published Application No. WO01/53573, European Published Patent Application No. EP1059372, and Japanese Published Patent Application JP61-032404. In addition, Japanese Published Patent Application Nos. JP49-124333, JP51-037376, and JP2002-54034 disclose methods of treating polyester bicomponent fibers. However, these and other methods of treating bicomponent fibers can result in fibers that have crimp values that are too high for satisfactory further processing. Accordingly, new methods of processing such fibers are sought.

SUMMARY OF THE INVENTION

In a first aspect, the present invention provides a continuous process for treating a polyester fiber. This process includes the steps of providing a bicomponent fiber comprising poly(ethylene terephthalate) and poly(trimethylene terephthalate) that has been heat-treated to a first heat-treating temperature and cooled to lower than about 70° C., applying tension to the fiber from of about 0.001 to 0.088 dN/tex, heat-treating the fiber at a second temperature no lower than about 75° C. and no higher than the first heat-treating temperature, cooling the fiber to lower than the second temperature, and releasing the tension from the fiber to give a fiber having a reduced crimp contraction value.

The present invention can further include an optional step of heat-treating the fiber at a third temperature in a relaxed state to give a fiber having a restored crimp contraction value. When this step is carried out dry, the third heat-treating temperature is higher than the second heat-treating temperature and lower than the first heat-treating temperature. When this step is carried out wet, the third heat-treating temperature is from about 60° C. to about 135° C.

In a second aspect, the invention provides a bicomponent fiber comprising poly(ethylene terephthalate) and poly (trimethylene terephthalate) having a reduced crimp contraction value of about 6% to about 15%. The fiber can further have a restored crimp contraction value of about 70% to about 100% of the precursor fiber's developed crimp contraction value. In this aspect of the invention, the fiber can be made by the process of the invention.

BRIEF DESCRIPTION OF THE FIGURE

The FIGURE is a schematic view of an apparatus that can be used in the process of the invention.

DETAILED DESCRIPTION OF THE PREFERRED EMBODIMENTS

The present invention relates to bicomponent polyester fibers comprising poly(ethylene terephthalate) and poly (trimethylene terephthalate) having certain crimp properties and to a process for adjusting the crimp of such fibers, and more particularly to a process for reducing and then restoring the crimp of such fibers.

It has been unexpectedly found that polyester bicomponent fibers comprising poly(ethylene terephthalate) and poly (trimethylene terephthalate) that have high initial crimp can be heat-treated to reduce temporarily the crimp for ease of additional processing, and thereafter post heat-treated to restore desirably high crimp values.

As used herein, "bicomponent fiber" means a fiber comprising two polyesters intimately adhered to each other along the length of the fiber. The fiber cross-section can be, for example, a side-by-side, eccentric sheath-core or any other suitable cross-section from which useful crimp can be developed.

As used herein, "initial" crimp contraction value refers to the crimp exhibited by the precursor bicomponent fiber before being subjected to the process of the invention.

As used herein, "developed" crimp contraction value refers to the crimp shown by the bicomponent fiber when it has been heat-treated while relaxed to develop the crimp, without having been subjected to processing steps of the invention.

As used herein, "reduced" crimp contraction value refers to the lower crimp (compared to the initial crimp) exhibited by the fiber after it has been treated by the process disclosed herein in which tension is applied to a fiber that has previously been heat-treated at a first temperature and cooled, after which the fiber is heat-treated at a second temperature, cooled, and subsequently released from tension.

As used herein, "restored" crimp contraction value refers to the crimp value exhibited by the fiber after it has been heat-treated to increase the crimp above that of the reduced crimp contraction value.

The precursor fiber can be prepared by melt-spinning poly(trimethylene terephthalate) and poly(ethylene terephthalate) into a bicomponent fiber, followed by drawing the fiber in a coupled or split process (for example at a draw ratio of about 1.44–4.5× and at a temperature of about 50° to about 185° C.).

The precursor fiber can then be heat-treated at a first temperature, which temperature can, for example, be from about 140° to about 185° C. The fiber can then be cooled to a temperature at or below about 70° C., such as, for example, a temperature of about 20° to about 70° C., generally without substantial relaxation, followed by packaging.

The time the precursor fiber is heated to the first heat-treating temperature can be about 0.01 to 0.1 seconds under dry conditions. Shorter times can be used under wet conditions, for example when pressurized steam is used. If the time is too short, the treated, inventive fiber's restored crimp contraction value may be too low, and if the time is too long, for example in a fully heat-treated precursor fiber, the treated, inventive fiber's reduced crimp contraction value may be too high.

The precursor fiber can also have been made by spinning it at high speed. For example, the fiber can be made by spinning it at a speed of at least about 4200 m/min, such as, for example, a speed of about 4500 to about 8000 m/min, such that drawing and first heat-treating effectively take place during spinning. Although a fiber so spun has not been subjected to the specific step-wise processing of a "fully drawn" fiber (drawing and first heat-treating), it can, nevertheless, be subjected to the process of the present invention as if it had experienced those conditions, since such a fiber has been found to have similar properties and similar responses to subsequent processing.

Whether separately drawn or high-speed-spun without specific drawing, the precursor fiber can have an initial crimp contraction value of about 8 to about 25% when measured soon after the fiber is removed from a wound package and before crimp development. The fiber can also have a lower initial crimp contraction value if the package is tightly wound or it can have a higher crimp contraction value if the fiber has been allowed to relax, for example as a tow in a piddle can. Optionally, the fiber's crimp can have been partially or entirely developed, for example by relaxed heat-treatment, before being subjected to the process of the present invention. The precursor fiber can have a developed crimp contraction value of about 20% to about 80%.

In the present process, the precursor bicomponent fiber is subjected to a tension of about 1.5 to about 100 mg/d (about 0.001 to about 0.088 dN/tex), preferably about 1.5 to about 30 mg/den (about 0.001 to about 0.026 dN/tex), more preferably about 1.5 to about 10 mg/d (about 0.001 to about 0.009 dN/tex). The fiber is subsequently heated to a second temperature, which temperature is no lower than about 75° C. and no higher than the first heat-treating temperature. The process of the invention can be operated at speeds of about 300 to about 3000 m/min, such as from about 400 to about 1000 m/min. At tension levels above about 0.088 dN/tex and temperature levels above about 185° C., undesirable permanent deformation of the fiber may occur so that the capability of the fiber to regain high crimp values on further, relaxed heating may be compromised. In other words, the restored crimp contraction values may be undesirably low. In addition, at tension levels below about 0.001 dN/tex and temperature levels below about 75° C., the desired reduction in crimp value may be difficult to obtain. That is, the reduced crimp contraction values may be undesirably high. In order to reduce the possibility of the occurrence of at least one of these undesirable effects, the second heat treatment temperature is preferably about 75° to about 185° C.

Following heating the fiber to the second temperature under tension, the fiber is cooled to a temperature that is lower than the second temperature, optionally lower than about 75° C., such as a temperature of about 20° to lower than about 75° C. After the fiber has been cooled, the tension is released to give a fiber having a reduced crimp contraction value. This value can be about 35% to about 70% of the precursor fiber's initial crimp contraction value, preferably about 35% to about 50% of the initial crimp contraction value. For example, the reduced crimp contraction value can be from about 6% to about 15%.

At this point, the fiber can optionally be briefly heat-treated again in the relaxed condition without restoring its crimp, provided its temperature does not exceed the second temperature. For example, the fiber can be re-heated to lower than the second temperature at 20% overfeed at 600 m/min or at 5% overfeed at 3000 m/min. Such an optional step can have a beneficial effect of reducing true shrinkage.

Additional process steps can be carried out on the reduced crimp fiber, for example: covering it with other fibers, or twisting, interlacing, or entangling it, optionally in combination with other fibers; cutting the fiber into-staple, then carding and preparing a spun yarn optionally as a blend with other staple fibers such as cotton; knitting or weaving the fiber (spun yarn or continuous filaments) into fabrics; or winding the fiber into tangle-free skeins, for example for yarn dyeing. In each case, the third heat-treatment described hereinafter can be applied to the product of such additional process step.

The fiber can be optionally heat-treated a third time in a relaxed state, such as at a tension of about 0 to about 1.4 mg/den (0 to 0.001 dN/tex), resulting in a restored crimp contraction value. This restored crimp contraction value can be at about 70% to about 100% of the developed crimp contraction value. This third heat treatment can be carried out wet or dry.

When such third heat-treating is carried out on dry fiber, for example in a tenter frame without deliberately adding moisture, the third temperature is higher than the second temperature but lower than the first temperature. For example, this third heat-treating can be carried out dry at temperatures of about 90° C. to about 170° C.

When such third heat-treating is carried out on wet fiber, for example by scouring or dyeing, the temperature is about 60° C. to about 135° C. The third heat-treatment can also be conducted while the fiber, for example in fabric form, is being dried.

The polyesters used to make the bicomponent fiber typically have different intrinsic viscosities (IV). For example, poly(ethylene terephthalate) having an IV of about 0.45 to about 0.80 dl/g and poly(trimethylene terephthalate) having an IV of about 0.85 to about 1.50 dl/g can be used. Copolymers of each polyester are also contemplated and are within the scope of the invention. For example, a copoly (ethylene terephthalate) can be used in which the comonomer is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and aromatic/aliphatic ether glycols having 4–10 carbon atoms (for example, hydroquinone bis(2-hydroxyethyl) ether, or a poly(ethyleneether) glycol having a molecular weight below about 460, including diethyleneether glycol). The comonomer can be present in the copolyester at values of about 0.5–15 mole percent.

Among the comonomers which may be used, isophthalic acid, pentanedioic acid, hexanedioic acid, 1,3-propane diol, and 1,4-butanediol are preferred because they are readily commercially available and inexpensive.

The copolyester(s) can contain minor amounts of other comonomers, provided such comonomers do not have an adverse affect on the amount of fiber crimp or on other properties. Such other comonomers can include 5-sodium-sulfoisophthalate, used, for example, at a level of about 0.2–5 mole percent. Very small amounts of trifunctional comonomers, for example trimellitic acid, can also be incorporated for viscosity control.

The weight ratio of the two polyesters in the fiber can be about 70:30 to about 30:70 poly(ethylene terephthalate) to poly(trimethylene terephthalate), for example about 40:60 to about 60:40 poly(ethylene terephthalate) to poly (trimethylene terephthalate).

The precursor fiber used in the present process can be in the form of a continuous filament, a yarn, or a tow suitable for subsequent cutting to make staple. The fiber can be of any size, for example 0.5–20 denier (0.6–22 dtex) per filament. When a plurality of fibers is combined into a yarn, the yarn can be of any size, for example up to 1300 decitex. Any number of filaments, for example 34, 58, 100, 150, or 200, can be used. Similarly, any size tow can be subjected to the process of the invention, for example up to 1,000,000 denier (1,111,000 dtex). Whether the cross-section of the bicomponent fiber is side-by-side or eccentric sheath-core, the fiber used in the process of the invention can have a "snowman", oval, substantially round, or scalloped oval shape. The fiber of the present invention comprises poly (ethylene terephthalate) and poly(trimethylene terephthalate) having a reduced crimp contraction value which can be about 6 to about 15%. Such fiber can be derived from a precursor fiber exhibiting an initial crimp contraction value of about 8 to about 25% and a developed crimp contraction value of about 20% to about 80%, and the inventive fiber can have a restored crimp contraction value that is at least about 70% (that is, about 70% to about 100%) of the precursor fiber's developed crimp contraction value. The fiber of the invention can be prepared by the process of the invention.

In the Examples, the following method was used to measure crimp contraction values. Each sample was formed into a skein of 5000+/−5 total denier (5550 dtex) with a skein reel at a tension of about 0.1 gpd (0.09 dN/tex). The skein was conditioned at 70+/−2° F. (21+/−1° C.) and 65+/−2% relative humidity for a minimum of 16 hours. The skein was hung substantially vertically from a stand, a 1.5 mg/den (1.35 mg/dtex) weight (e.g. 7.5 grams for a 5550 dtex skein) was hung on the bottom of the skein, the weighted skein was allowed to come to an equilibrium length, and the length of the skein was measured to within 1 mm and recorded as "$C_b$". The 1.35 mg/dtex weight was left on the skein for the duration of the test. Next, a 500 gram weight (100 mg/d; 90 mg/dtex) was hung from the bottom of the skein, and the length of the skein was measured to within 1 mm and recorded as "$L_b$". Crimp contraction value (percent) (before heat-setting, as described below for this test), "$CC_b$", was calculated according to the formula $$CC_b=100\times(L_b-C_b)/L_b$$

The 500 g weight was removed, and the skein was then hung on a rack and heat-set, with the 1.35 mg/dtex weight still in place, in an oven for 5 minutes at about 250° F. (121° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "$C_a$". The 500-gram weight was again hung from the skein, and the skein length was measured as above and recorded as "$L_a$". The after heat-set crimp contraction value (percent), "$CC_a$", was calculated according to the formula $$CC_a=100\times(L_a-C_a)L_a$$

When determined on fiber before it was subjected to the process of the invention, $CC_b$ measured the "initial" crimp contraction value. When determined on fiber after it had been heat treated while relaxed to develop the crimp but without being subjected to the process of the invention, $CC_a$ measured "developed" crimp contraction value. "Initial" and "developed" crimp contraction values are characteristics of the precursor fiber. When determined on fiber subjected to the tension, second temperature, cooling, and release steps of the invention, $CC_b$ measured "reduced" crimp contraction value. When determined on fiber subjected to the tension, second temperature, cooling, and release steps of the invention, $CC_a$ measured "restored" crimp contraction value, because the test method itself included a relaxed heat-treating (third temperature) step.

EXAMPLES

Example 1

The precursor fiber was 167 decitex, 34 filament Type 400 poly(ethylene terephthalate)//poly(trimethylene terephthalate) bicomponent yarn (from Invista, Inc.) which had been drawn about 3× and heat-treated at 170° C. Its initial crimp contraction value was 18.7%, and its developed crimp contraction value was 43.4%. Using an SSM Stähle-Eltex DP2-T Air Jet Texturing Machine equipped with independent roll drives and heaters, the fiber was passed under tension between the first two rolls using eight wraps on each roll one at a time and then to the windup at 700 m/min (windup speed). The temperature of the first roll was set at 100° C., and the second roll at 160° C. The resulting (second) temperature of the yarn while it was under tension is believed to have been about 100° C. Using a hand-held tensiometer, the tension between the first two rolls was determined to be 4 grams, or 27 mg/d (0.024 dN/tex). Cooling to room temperature (about 25° C.) and tension release took place between the second roll and the windup. Although a Heberlein HemaJet LB-02 air-texturing jet was installed on the apparatus, it was not used. The reduced crimp contraction value of the fiber as taken from the windup was 12.3%, or 66% of the initial crimp contraction value. The restored crimp contraction value was 35.8%, or 82% of the developed crimp contraction value.

Example 2 (Comparison)

Using the same fiber and apparatus as in Example 1, both rolls were set at 160° C. The first roll was operated at 693 m/min, the second at 728 m/min, and the windup at 700 m/min. The tension between the first two rolls was determined to be 20 grams, or 133 mg/den (0.117 dN/tex). The reduced crimp contraction value of the fiber as taken from the windup was 5.8%, or 31% of the initial crimp contraction value. The restored crimp contraction value was 28.3%, or only 65% of the developed crimp contraction value.

Example 3

The precursor fiber was 83 decitex, 34 filament Type 400 polyester bicomponent yarn (from Invista, Inc.) which had been drawn about 4× and heat-treated at 170° C. Its initial crimp contraction value was 16.5%, and its developed crimp contraction value was 40.4%. A Rieter Industrie Controll éBernard Terrat twin heater false-twist texturing machine (model FT12E2) was used, but without engaging the discs, so no twist was applied. Referring to the FIGURE, yarn 12 was passed from package 1 in the direction indicated by arrow 13 through feed rolls 2 and around guides 3 to primary heater 4, which had a length of 2 meters and was operated at 160° C.; the yarn's (second) temperature while it was under tension is believed to be below 120° C. Cooling zone 5 had a length of 0.6 meters and was operated at about 25° C., without supplying additional air. The heat-treated yarn was then passed over guide 6 (at which a circumferential speed of 600 m/min was measured) and between draw rolls 7, which were operated at a circumferential speed that was 5% higher than that of feed rolls 2, thus providing low yarn tension in the primary heater. Optional second heater 8 had a length of 1.4 meters and was also operated at 160° C. The yarn path distance between the exit of cooling zone 5 and the entrance of second heater 8 was 750 mm. Heater take-out rolls 9 were operated at a circumferential speed that was 15% lower than that of draw rolls 7, so that the yarn relaxed slightly; this optional relaxation step was judged insufficient to develop significant additional crimp, a conclusion which was substantiated by the results obtained. The yarn was then passed around guide 10 to windup 11. The reduced crimp contraction of the fiber as taken from the windup was 6.4%, or 39% of the initial crimp contraction value. Its restored crimp contraction value was 34.9%, or 86% of the developed crimp contraction value.

What is claimed is:

1. A continuous process for treating a bicomponent polyester fiber comprising the steps of:

a) providing a bicomponent fiber comprising poly (ethylene terephthalate) and poly(trimethylene terephthalate) that has been heated to a first heat-treating temperature and cooled to a temperature below about 70° C.; wherein the fiber has an initial crimp contraction value and a developed crimp contraction value;

b) applying tension to the fiber of about 0.001 to about 0.088 dN/tex;

c) heat-treating the tensioned fiber at a second heat-treating temperature that is no lower than about 75° C. and no higher than the first heat-treating temperature;

d) cooling the fiber to lower than the second heat-treating temperature;

e) releasing the tension from the fiber, wherein the resulting treated bicomponent fiber has a reduced crimp contraction value.

2. The process of claim 1, further comprising a step of f) heat-treating the fiber at a third heat-treating temperature, while the fiber is in a relaxed state to give a fiber having a restored crimp contraction value, wherein when the step is carried out dry, the third heat-treating temperature is higher than the second heat-treating temperature and lower than the first heat-treating temperature, and when the step is carried out wet, the third heat-treating temperature is from about 60° C. to about 135° C.

3. The process of claim 1, wherein the fiber is heat-treated at a first heat-treating temperature of about 140° C. to about 185° C., and the reduced crimp contraction value is about 35% to about 70% of the initial crimp contraction value.

4. The process of claim 3, wherein the initial crimp contraction value is from about 8% to about 25%, the fiber is cooled in step a) to a temperature of about 20° C. to about 70° C., the tension in step b) is from about 0.001 to about 0.026 dN/tex, the second heat-treating temperature in step c) is from about 75° C. to about 185° C., the fiber is cooled in step d) to a temperature of about 20° C. to about 75° C., and the resulting treated fiber has a reduced crimp contraction value of about 6% to about 15%.

5. The process of claim 2, further comprising, between steps e) and f), an additional step selected from the group consisting of:

(i) cutting the fiber into staple, carding the staple, and preparing a spun yarn of the staple, wherein step f) is carried out on the spun yarn;

(ii) forming a fabric selected from the group consisting of knits and wovens, wherein step f) is carried out on the fabric;

(iii) winding the fiber into a skein, wherein step f) is carried out on the skein;

(iv) covering the fiber, wherein step f) is carried out on the fiber so covered;

(v) twisting the fiber, wherein step f) is carried out on the fiber so twisted;

(vi) interlacing the fiber, wherein step f) is carried out on the fiber so interlaced; and (vii) entangling the fiber, wherein step f) is carried out on the fiber so entangled.

6. The process of claim 1, wherein the tension in step b) is from about 0.001 to about 0.026 dN/tex.

7. The process of claim 2, wherein the fiber has a developed crimp contraction value of about 20% to about 80%, and the restored crimp contraction value is about 70% to about 100% of the developed crimp contraction value.

* * * * *